United States Patent [19]

Reif et al.

[11] Patent Number: 4,529,418

[45] Date of Patent: Jul. 16, 1985

[54] INLET SECTION FOR INERTIAL-ELECTROSTATIC PRECIPITATOR UNIT

[75] Inventors: Robert B. Reif, Grove City; Paul E. McCrady, Columbus, both of Ohio

[73] Assignee: Santek, Inc., Greensboro, N.C.

[21] Appl. No.: 339,711

[22] Filed: Jan. 15, 1982

[51] Int. Cl.[3] ..... B03C 3/16; B03C 3/53

[52] U.S. Cl. ..... 55/119; 55/127; 55/151; 55/154; 55/155; 55/228; 55/238; 55/241; 55/435; 55/459 R; 55/472; 55/DIG. 38; 261/79 A; 261/112

[58] Field of Search ..... 55/118, 119, 122, 127, 55/155, 154, DIG. 38, 238, 241, 435, 472, 151, 459 R; 261/79 A, 112

[56] References Cited

U.S. PATENT DOCUMENTS

| | | | |
|---|---|---|---|
| 538,557 | 4/1895 | Theisen | 55/119 X |
| 2,259,030 | 10/1941 | Fisher | 55/238 X |
| 3,218,781 | 11/1965 | Allemann et al. | 55/155 X |
| 3,750,373 | 8/1973 | Olson | 55/155 X |
| 3,765,154 | 10/1973 | Hardt et al. | 55/146 |
| 3,785,125 | 1/1974 | DeSeversky | 55/119 |
| 4,308,038 | 12/1981 | Michel | 55/118 |

FOREIGN PATENT DOCUMENTS

| | | | |
|---|---|---|---|
| 69980 | 6/1978 | Japan | 55/155 |

*Primary Examiner*—Kathleen J. Prunner
*Attorney, Agent, or Firm*—Michael Ebert

[57] ABSTRACT

An electro-inertial precipitator unit for removing particulate contaminants from a gaseous stream passing through a collector tube having a discharge electrode coaxially disposed therein to establish an electrostatic field between the electrode and a downwardly-flowing liquid film on the inner surface of the tube. The gaseous stream is introduced tangentially into an upper inlet section of the tube to impart a swirling motion thereto, the liquid being supplied to an annular inlet slot just below the gas inlet section. Because of the centrifugal force generated by the cyclonic motion, the particles in the gaseous stream are urged to migrate toward the liquid film, this migration being further promoted by the electrostatic force acting on the particles which are charged with ions in the field. To avoid wetting of the inlet section, thereby causing dust to deposit thereon, this inlet section is provided with a hydrophobic surface in the region above the inlet slot.

2 Claims, 4 Drawing Figures

PRESSURIZED AIR SOURCE
HYDROPHOBIC SURFACE
CONTAMINATED GASEOUS STREAM
POWER SUPPLY
WATER FILM
WATER FILM
WATER FILM
WATER INLET
VALVE CONTROL CIRCUIT
PURIFIED GASEOUS STREAM
MOTOR CONTROL
PUMP

INLET SECTION FOR INERTIAL-ELECTROSTATIC PRECIPITATOR UNIT

BACKGROUND OF INVENTION

This invention relates generally to apparatus for removing particulate contaminants from a gaseous stream, and more particularly to a self-cleaning electro-inertial precipitator unit in which particles charged by ions are induced to migrate toward a downwardly-flowing liquid film formed on the inner surface of a collector tube, the migration resulting from the combined action of electrostatic and centrifugal forces whereby the stream may be purified in the course of its passage through a relatively short collector tube.

Electrostatic precipitators separate contaminating particles or droplets of a semi-solid or solid nature from a gaseous stream. Such precipitators are especially helpful in removing finer particles (less than 40$\mu$) which cannot be extracted by conventional filters or other particle separators. In one known form of electrostatic precipitator of the dry type, the gases to be purified are conveyed through a collector tube where the particles are charged with ions in an electrostatic field, the charged particles migrating toward the inner surface of the collector tube having an opposite charge, thereby separating the particles from the gas flowing through the tube. With continued operation of a dry precipitator, the particles accumulate on the wall of the collector tube and it becomes necessary, therefore, at fairly frequent intervals, to shut down the precipitator in order to permit removal of the agglomerated particles.

With a wet-wall precipitator of the type disclosed, for example, in the deSeversky Pat. No. 3,716,966, a uniform film of downwardly flowing water is formed on the inner surface of the collector tube, the film serving to continuously flush away the contaminants, thereby obviating the need to interrupt the operation of the precipitator.

The use of centrifugal separators or cyclonic collectors for separating dust particles and other particulate contaminants of 25$\mu$ or larger from a gaseous stream is well known. In order, therefore, to effectively remove both large and small particles from a gaseous stream, one may first feed the gaseous stream through a cyclonic collector or inertial dust separator stage to extract the large particles from the stream and then feed the partially purified stream through an electrostatic precipitator stage to extract the fine particles therefrom as well as those larger particles not extracted in the preceding stage.

Thus Pat. No. 3,315,445 to deSeversky discloses a pollution control system in which gas scrubber and wet electrostatic precipitator stages are intercoupled in cascade relation so as to remove the full spectrum of contaminants from the stream. The practical drawback to the deSeversky arrangement, apart from the relatively high cost of providing both a gas scrubber and a wet electrostatic precipitator, is that these two units occupy a substantial amount of space. This creates installation difficulties in those installations where space is at a premium.

In the above-identified related patent applications, there is disclosed an electro-inertial wet-wall precipitator unit in which both fine and coarse particles are extracted from a contaminated gaseous stream by the combined action of centrifugal and electrostatic forces.

The advantage of the apparatus disclosed in the prior applications is that it carries out in a single compact, integrated unit, functions heretofore requiring at least two units.

In the electro-inertial precipitator disclosed in the prior applications, the gaseous stream to be purified is fed at high velocity tangentially into an upper inlet section of a vertical collector tube to impart a cyclonic or swirling motion thereto, thereby causing the gas to flow in a helical path down the tube along a downwardly-flowing water film to impose an inertial force which imparts a swirling motion thereto serving to maintain the film against the tube surface.

Supported coaxially within the collector tube is a discharge electrode, a high voltage being impressed between the electrode and the water film to create an electrostatic field therebetween the ions generated by the discharge electrode charging the particles carried by the gas. The centrifugal force created by the swirling motion of the gas induces the particles conveyed thereby to migrate toward the water film. This migration is further promoted by the action of the electrostatic field which causes the charged particles to travel toward the oppositely-charged water film. As a consequence, both coarse and fine particles are extracted from the gas and captured by the water film which washes the particles into the sump below the outlet section of the tube.

It has been found that when an electro-inertial wet-wall precipitator of the prior type is used to extract fine, low-density dust from a gaseous stream, such as sub-200 mesh grain dust in concentrations typically encountered in dusthandling systems in grain elevators, the operation of the unit is impaired by the nature and concentration of such dust.

To begin with, the grain dust does not wash cleanly from the inner surface of the tube, for spiral dust streaks tend to develop thereon, even though a normal water flow rate of about 0.5 gallons per minute per 1000 C.F.M. of gas is sufficient to keep the tube clean with low concentrations of dust such as cotton dust encountered in textile mills. Once these dust streaks are developed, even an above-normal increase in water flow rate will fail to flush the streaks away. While these streaks could be prevented from forming by setting the flow rate at start up to an above-normal level, this increase in flow rate eventually leads to water entrainment in the gaseous stream and requires more water processing and greater power to pump the water.

It has also been found that grain dust tends to form a cake at the upstream side of the water inlet slot in the precipitator tube, this cake slightly overlapping the slot at various points, thereby impeding the water flow and disturbing the uniformity of the water film. Moreover, these cakes occasionally break off and deposit on the wet wall at sites where they are difficult to wash away, such occurrences sometimes giving rise to arcing. In addition to dust streaks and dust cakes, dust deposits are formed in other regions of the precipitator structure which act to foul the unit and interfere with its proper operation.

Another problem encountered in wet-wall precipitator units in which a discharge electrode wire is extended between electrical insulating rods is that the rod which is exposed to the incoming contaminated gas stream will in time acquire a deposit of conductive particles thereon when the gas stream is the effluent of a welding process or other industrial operation which discharges more or less electrically-conductive particles into the atmosphere. This conductive deposit on the insulating rod degrades its insulating properties and may result in an electrical breakdown.

Yet another problem encountered in wet-wall precipitator units, particularly those which make use of large diameter collector tubes which operate at exceptionally high voltages exceeding 100 KV, is arcing as a result of water or other liquid projecting from the water inlet into the air gap between the discharge electrode and the inner surface of the collector tube. Ideally, water from the inlet should flow downwardly therefrom against the inner surface of the collector tube to create a water film thereon; but in practice, the configuration of the inlet and the velocity of water flow are such as to cause the water to somewhat shoot out of the inlet into the air gap to provide a conductive path in the air gap giving rise to arcing.

SUMMARY OF INVENTION

In view of the foregoing, the main object of this invention is to provide an electro-inertial wet-wall precipitator unit which extracts both coarse and fine particles from a gaseous stream by the combined action of centrifugal and electrostatic forces, the inlet section of the unit having a hydrophobic surface to avoid wetting thereof.

More particularly an object of this invention is to provide a precipitator unit of the above type which operates effectively even when the particles to be extracted from the gaseous stream are constituted by fine, low density dust, the precipitator being maintained free of dust formations in the region above the liquid inlet slot.

Also an object is to provide a compact precipitator unit of the above type which operates efficiently and reliably and has low energy requirements.

Briefly stated, these objects are attained in an electro-inertial wet wall precipitator unit for removing particulate contaminants from a gaseous stream passing through a collector tube having a discharge electrode coaxially disposed therein to establish an electrostatic field between the electrode and a downwardly-flowing liquid film on the inner surface of the tube. The gaseous stream is introduced tangentially into an upper gas inlet section in the tube to impart a swirling motion thereto, the liquid being supplied to an annular inlet slot just below the gas inlet section.

Because of the centrifugal force generated by the cyclonic motion, the particles in the gaseous stream are urged to migrate toward the liquid film, this migration being further promoted by the electrostatic force acting on the particles which are charged with ions in the field. To avoid wetting of the inlet section, thereby causing dust particles to deposit thereon, the inlet section, at least in the region directly above the liquid inlet slot, is provided with a hydrophobic surface.

OUTLINE OF DRAWINGS

For a better understanding of the invention as well as other objects and further features thereof, reference is made to the following detailed description to be read in conjunction with the accompanying drawings, wherein:

FIG. 1 schematically illustrates an electro-inertial precipitator unit in accordance with the invention;

DESCRIPTION OF INVENTION

Figures 1, 2, 3, 4:
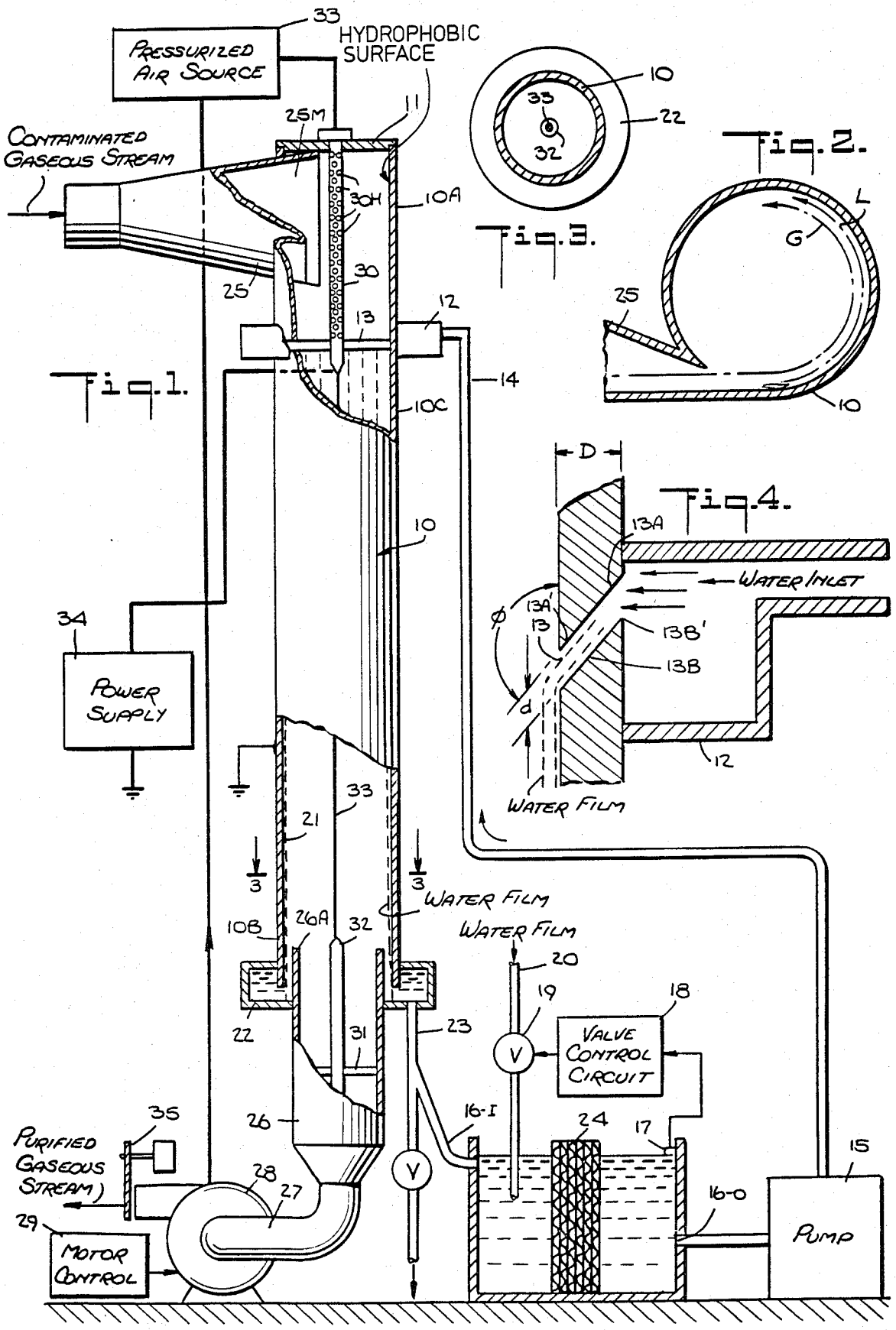
FIG. 2 illustrates the manner in which the gaseous stream is tangentially introduced into the collector tube of the unit.
FIG. 3 is a transverse section taken in the plane indicated by line 3—3 in FIG. 1.
FIG. 4 is a transverse section taken through the water distributor of the unit.

Referring now to FIG. 1 which illustrates an electro-inertial precipitator unit in accordance with the invention, it will be seen that the unit includes a vertically-mounted collector tube 10. The inlet section 10A at the upper end of the collector tube is closed by a cover 11, the outlet section 10B at the lower end being open. In practice, when the unit is used in a commercial installation, such as in grain elevators to extract grain dust from the contaminated atmosphere, tube 10 may have a 24-inch diameter and a 6-foot length.

Encircling tube 10 is a water distributor 12 which supplies water or liquid to an annular inlet slot 13 disposed at the junction of inlet section 10A and the main section 10C of the collector tube. Water is fed into distributor 12 through a pipe 14 by a motorized pump 15 which draws the water from the output port 16-O of an open reservoir or tank containing water.

Inlet slot 13, as shown in FIG. 4, is downwardly inclined relative to the vertical wall of collector tube 10. The thickness of collector tube 10 is represented by value D, the width of the slot by value d, and the angle of the slot by symbol $\theta$. The configuration of the slot which takes into account the above values and angle is such as to prevent the water from shooting out of the slot into the collector tube and to cause the water emitted therefrom to flow downwardly against the inner surface of the tube to create a water film thereon.

Slot 13 is defined by an angled bank 13A and a complementary lower bank 13B. In the absence of inclination, water forced through slot 13 would tend to project into the collector tube and create arcing problems. In order to prevent the water from shooting out, the incoming water flowing in horizontal paths toward slot 13, as indicated by the arrows, is intercepted by inclined upper bank 13A and deflected downwardly thereby.

To insure such interception, it is essential that the apex 13A' of the upper bank be no higher than the apex 13B' of the lower bank. The relative position of these apexes is a function of angle $\theta$ and values d and D. Since the width of the slot is determined by the water demand of the unit, and the thickness D by structural requirements, for given values of d and D, one must choose a slot angle $\theta$, such as 45 degrees or higher, which insures interception of the water entering the slot by the upper bank and downward deflection thereby.

To maintain the water in the tank at a desired level, a level sensor 17 is provided which yields a signal that is applied to the control circuit 18 of a solenoid-operated valve 19. Valve 19 is interposed in a water input line 20 leading to a make-up water supply, the valve being opened only when the level of water in the tank falls below a predetermined level. Since the water in the unit is recirculated therein, the control system acts to replenish water lost through evaporation or drained from the tank.

Water emerging from annular inlet slot 13 flows down the inner surface of the main section 10C of the collector tube to create a uniform cylindrical water film 21 on the inner surface thereof, this film being discharged into a sump 22 surrounding outlet section 10B. Sump 22 returns the collected water through a gravity-flow pipe 23 into the input port 16-I of the tank. In practice, sump 22 may be provided with baffles to prevent backflow of the water into the collector tube, for such backflow may cause arcing.

Interposed between the input and output regions of the tank is a replaceable filter 24 which intercepts and captures the dirt in the water drained from the collector tube so that the water returned to the tube is reasonably clean. Thus the water system associated with the precipitator unit is a closed loop in which the water is continuously recycled. In some cases, however, depending on the nature of the contaminants carried by the gaseous stream, the contaminant-laden water must be drained and not filtered and recycled.

The downwardly-flowing liquid film 21 flushes away contaminants collected by the film; and while water may be used for this purpose, in practice the flushing liquid may be a liquid having properties compatible with the gas to be purified. In some instances, it may be desirable to include a surfactant in the liquid to enhance its wetting characteristics to ensure wetting of the entire inner surface of the collector tube. Should use be made of a collector tube of ceramic or other electrical insulating material, rather than a metal tube which is electrically grounded, use is then made of a liquid such as as ordinary tap water having an adequate degree of electrical conductivity, the liquid film in this case being grounded.

The gaseous stream to be purified is introduced into inlet section 10A of the collector tube through a spinner duct 25 constituted by a horn-shaped transition section having a somewhat flattened mouth 25 M. As shown in FIG. 2, duct 25 feeds the contaminated gas tangentially into the inlet section at one side thereof at high velocity, thereby causing the gas to undergo cyclonic or swirling motion. The upper end of duct mouth 25 M is flush with the tube cover 11 so that no free space exists between the mouth and the cover. In practice, a tangential gas inlet feed may be provided by vanes which impart a swirl component to the incoming gaseous stream.

This flush duct arrangement is necessary to eliminate stagnant gas swirls in this upper region of the precipitator tube. Such stagnant swirls would be produced were the mouth of the duct displaced below the cover 11, the dust deposits building up and resulting eventually in chunks which break off and fall into the precipitator tube where they give rise to arcing and also overload the flushing system.

Received within outlet section 10B of the collector tube is a tubular flue 26 whose inlet 26A is spaced from the inner surface of outlet section 10B to avoid disrupting the downward flow of liquid into sump 22. Flue 26 is coupled by an elbow 27 to a fan-type blower 28 whose purified gaseous output is exhausted into the atmosphere. Blower 28 is operated by a motor control circuit 29. When the contaminated stream is air at an elevated temperature, as is often the case in an industrial installation, the purified output stream may be used for room heating purposes rather than being wasted, for the degree of de-contamination is such as to render the air breathable.

Supported below cover 11 coaxially within the upper section 10A of the precipitator tube is an electrical insulating rod 30 whose tip is positioned somewhat below annular inlet slot 13. Supported coaxially within flue 26 by a spider 31 is a similar electrical insulating rod 32. Extending between the tips of the insulating rods and secured thereto is discharge electrode wire 33, the rods in combination with the wire forming the discharge electrode assembly of the unit. In practice, for a collector having a 4-inch diameter, the discharge wire may have an 8 mil diameter. But for collector tubes of larger diameter, larger diameter discharge electrode wires are appropriate, such as 30 mils or greater.

The upper insulating rod 30 is extended at least one or two inches below annular inlet slot 13. Consequently, discharge electrode wire 33 does not extend above slot 13 where charged particles would, because of the resultant electrostatic field, tend to deposit and remain on the inner surface of the inlet section 10A of the collector tube which is not flushed with water. Such deposition will foul the precipitator and is obviously undesirable. The actual distance of rod 30 below inlet slot 13 depends on the diameter of the precipitator tube: the larger the diameter, the greater this distance.

It is to be noted that since the upper insulating rod 30 is positioned within inlet section 10A which receives the contaminated gaseous stream, if the particles in the stream are somewhat conductive and adhere to the surface of the insulating rod, the resultant deposit may impair the electrical insulating properties of the rod and cause a short circuit. To minimize the exposure of rod 30 to such conductive particles, the mouth of the inlet section is arranged to blow the incoming gaseous stream to one side of the inlet section 10A and thereby sidestep the rod.

However, since inlet section 10A is suffused with the incoming gaseous stream, additional means must be provided to prevent fouling of insulating rod 30. To this end, insulating rod 30 is preferably of hollow construction and is provided with a circumferential array of holes 30H. Rod 30 is coupled to a pressurized air source 33 or to a suitable blower causing jets of air to be projected through the holes, these air jets preventing the deposit of dust particles on the rod surface. This expedient is particularly useful when the contaminated gaseous stream is derived from welding fumes carrying conductive particles. In practice, the pressurized air may be derived from the purified output of blower 28, thereby creating a closed rod purging system. Also, since in the embodiment shown, collector tube 10 operates under negative pressure, holes may be drilled in cover 11 concentrically about the point at which insulating rod 30 is supported, whereby clean atmospheric air is sucked through these holes to produce an air stream purging the surface of the rod.

Alternatively, use may be made of a solid upper insulating rod in conjunction with vanes disposed at the upper end thereon in conjunction with pressurized clean air, the vanes acting to impart to the air projected along the rod surface a swirling pattern which serves to divert dirt and to purge the surface from whatever dirt is deposited thereon.

A direct-current high voltage of a magnitude such as 20 to 100 KV and higher is impressed between electrode wire 33 and grounded collector tube 10 by means of a suitable power supply 34. This voltage establishes an electrostatic field in the gas flow region in the precipitator tube between the discharge electrode and the liquid film 21 on the inner surface of the collector tube, the field acting to produce ions at the discharge electrode which charge particulate contaminants passing through the tube. In practice, particles in the gaseous stream, before being admitted into the tube, may be charged by a pre-ionization stage.

Because the contaminated gaseous stream is fed tangentially into inlet section 10A and flows at high velocity by reason of the strong suction force developed by blower 28 coupled to outlet section 10B, the incoming stream is caused to spin cyclonically or swirl. This swirling motion causes the gas to spiral downwardly in a helical path and to impart a similar spiral motion to the liquid film flowing down the inner surface of the precipitator tube. And because the gas helix imposes an inertial force, this force acts to maintain the film against the collector tube.

In FIG. 2, the tangentially-introduced gaseous stream is represented by arrow G and the liquid film which is caused to swirl in the same direction in tube 10 is represented by arrow L. Because of centrifugal force created by the swirling motion of the gas within the precipitator tube, the momentum imparted to the particles in the gas stream urges the particles to migrate laterally toward the liquid film and to be collected and flushed away thereby. As pointed out previously, such inertial separation is generally more effective with relatively coarse and heavy particles than with fines.

The electrostatic field created by discharge electrode wire 33 extends between this wire and the corresponding surface of the water film surrounding the wire. This field acts to charge with ions the particles in the gaseous stream which pass through the field in a direction normal to the electric field lines. Because of the electrostatic force, the charged particles are urged to migrate toward the grounded liquid film, this force being effective with fine particles as well as coarse particles. Hence the combined action of inertial and electrostatic forces causes the full spectrum of particle sizes to be extracted from the gaseous stream.

Thus the contaminated gaseous stream drawn into inlet section 10A of the precipitator tube emerges from outlet section 10B with virtually all contaminants removed therefrom.

As noted previously, when the particles take the form of fine, low-density grain dust, spiral dust streaks tend to develop on the inner surface of the collector tube, and these do not flush away at flow rates normally sufficient to keep the tube clean. We have found that by pulsing the gaseous stream by repeatedly blocking the outlet of blower 28 by means of a solenoid-operated shutter 35, the resultant pulsatory wave acts to change the swirl pattern of the gas, and in turn to modify the swirl pattern of the liquid film. This shift in the liquid swirl pattern acts to quickly wash the dust streaks from the tube surface. In practice, the blocking action may be effected at the inlet side of the blower.

Shutter 35 is actuated so that each temporary blockage takes place abruptly for a fraction of a second, this action being repeated until the dust streaks are scrubbed away. In practice, pulsing may be effected by other means, such as by controlling the operation of blower 28.

Also, as noted previously, when the particles in the gaseous stream are fine grain dust, the dust tends to deposit on the upstream side of the annular inlet slot 13 in the inlet section 10A, for the surface of this section is not washed by the liquid film. In time, this dust deposit builds up to form a cake which slightly overlaps the annular liquid inlet slot in some areas thereof, thereby impeding full flow of liquid from the slot and disturbing the uniformity of the liquid film.

This interference produces an uneven flushing action. In operation, therefore, chunks of the resultant dust cake occasionally break off and are deposited on the wet wall. This fouls the liquid film on the wall, and in some instances results in excessive arcing.

In order to prevent the wicking of water onto the otherwise dry surface of inlet section 10A of the tube above liquid inlet slot 13 where wetness causes dust to stick to this surface, the surface of the inlet section is rendered hydrophobic by means of a substance having a distinct tendency to repel water in a manner characteristic of oily, waxy or fatty material. This hydrophobic property is found not only in waxes and many resins, but also in finely-divided powders such as fumed silicon dioxide (HFSD), material of this composition sold by Cabot Corporation under the Silanox trademark. Thus the surface of inlet section 10A may be coated with a face layer that includes HFSD or other suitable hydrophobic material. Or the inlet section may be entirely fabricated or lined with a material such as Teflon (PTFE) or an acrylic such as Lucite having pronounced hydrophobic properties.

A wet-wall unit in accordance with the invention is self-cleaning; for the arrangement is such that contaminants, even in those regions where contaminants tend to deposit despite flushing, deposition is inhibited or scrubbed away.

While there has been shown and described a preferred embodiment of electro-inertial wet-wall precipitator unit in accordance with the invention, it will be appreciated that many changes and modifications may be made therein without, however, departing from the essential spirit thereof.

We claim:

1. An electro-inertial precipitator unit for extracting particles from a contaminated gaseous stream, the unit comprising:

A a vertically-mounted collector tube whose upper end is enclosed by a cover, said tube having an upper inlet section, a main section and an open-ended outlet section;

B a discharge electrode assembly including a wire extending through said main and outlet sections and having a voltage impressed thereon relative to said collector tube to establish an electrostatic field therein which causes ions to be generated at said wire;

C means including an annular water inlet slot at the junction of the inlet and main sections of the tube to feed water therein to form a water film on the inner surface of the tube which flows downwardly into and is discharged from the open end of the outlet section, said inlet section, at least in the region directly above said water inlet slot having a hydrophobic surface;

D means to introduce said contaminated gas stream tangentially into said inlet section, water being repelled from the hydrophobic surface of the inlet section whereby particles in said stream are prevented from depositing thereon; and E means coupled to said outlet section to produce a suction force drawing said stream from the inlet section at high velocity and in conjunction with said means to introduce the stream tangentially into said inlet section imparting a swirling motion thereto to cause said gaseous stream to flow in a helical path down the tube against the liquid film and to induce a swirling pattern therein, the centrifugal force created by the swirling motion urging particles carried by the stream to migrate and to be collected by the film and to be flushed out of the tube, which migration is further promoted by the electrostatic force acting on the particles which are charged by the ions in the field.

2. A unit as set forth in claim 1, further including a sump surrounding the open end of the outlet section to receive said water and means to filter water derived from the sump and to return it to said annular slot.

* * * * *